US006732008B2

(12) United States Patent
Bailie

(10) Patent No.: US 6,732,008 B2
(45) Date of Patent: May 4, 2004

(54) SOFTWARE PROGRAM AND SYSTEM FOR EVALUATING THE DENSITY OF AN EMBROIDERY MACHINE DESIGN

(75) Inventor: Brian D. Bailie, 9913 Toltec NE., Albuquerque, NM (US) 87111

(73) Assignee: Brian D. Bailie, Albuquerque, NM (US)

( * ) Notice: Subject to any disclaimer, the term of this patent is extended or adjusted under 35 U.S.C. 154(b) by 301 days.

(21) Appl. No.: 09/792,505

(22) Filed: Feb. 23, 2001

(65) Prior Publication Data

US 2004/0015257 A1 Jan. 22, 2004

(51) Int. Cl.[7] ..... G06F 19/00; D05B 21/00
(52) U.S. Cl. ..... 700/138; 112/102.5
(58) Field of Search ..... 700/137, 138, 700/136; 112/102.5, 470.06, 475.19

(56) References Cited

U.S. PATENT DOCUMENTS 5,794,553 A * 8/1998 Futamura ..... 700/138 X
5,934,209 A * 8/1999 Mizuno ..... 112/102.5
5,954,004 A * 9/1999 Futamura ..... 700/138 X
6,209,467 B1 * 4/2001 Tomita ..... 700/138 X

* cited by examiner

*Primary Examiner*—Peter Nerbun
(74) *Attorney, Agent, or Firm*—Senniger, Powers, Leavitt & Roedel

(57) ABSTRACT

A software program and system for assisting an operator in analyzing an embroidery design which will be used by an embroidery machine to create an embroidered fabric. Grid software divides the embroidery design to be analyzed into a plurality of grid sections. Value software assigns a value to each particular grid section. The assigned value corresponds to a density of the embroidery design within the particular grid section. Display software provides a display of the grid sections of the divided embroidery design wherein each grid section has a parameter corresponding to its assigned value. The grid size may be proportionally adjusted to accommodate thread stretch.

22 Claims, 4 Drawing Sheets

SOFTWARE PROGRAM AND SYSTEM FOR EVALUATING THE DENSITY OF AN EMBROIDERY MACHINE DESIGN

BACKGROUND OF THE INVENTION

The invention relates to a software program and system for assisting an operator in analyzing an embroidery design which will be used by an embroidery machine to create an embroidered fabric. In particular, the invention assists the operator in adjusting density of an embroidery design.

Embroidery designs which are too dense need to be identified and adjusted so that the design will be attractive and will not damage the base fabric. In order for an operator of an embroidery machine to know a design's density and/or how well a design will sew, the operator must actually sew the design as a test. This process of making a test design can be extremely time consuming, given that the average machine will sew at a rate of 400 stitches per minute, and designs are typically in the 10,000–80,000 stitch range.

There is a need for a system which can assist the operator in evaluating a design to minimize or avoid the need for sewing the design or part of it as a test. There also is a need for a system for assisting an operator in determining and/or evaluating the actual density of an embroidery design.

SUMMARY OF THE INVENTION

In one form, the invention comprises a software program for assisting an operator in analyzing an embroidery design which will be used by an embroidery machine to create an embroidered fabric. Grid software divides the embroidery design to be analyzed into a plurality of grid sections. Value software assigns a value to each particular grid section which assigned value corresponds to a density of the embroidery design within the particular grid section.

In another form, the invention comprises a software program for assisting an operator in analyzing an embroidery design which will be used by an embroidery machine to create an embroidered fabric. Grid software divides the embroidery design to be analyzed into a plurality of grid sections. Display software provides a display of the grid sections of the divided embroidery design wherein each particular grid section has a parameter corresponding to a density of the embroidery design within the particular grid section.

In another form, the invention comprises a system for assisting an operator in analyzing an embroidery design which will be used by an embroidery machine to create an embroidered fabric. A personal computer includes grid software, value software and display software. The grid software divides the embroidery design to be analyzed into a plurality of grid sections. The value software assigns a value to each particular grid section which assigned value corresponds to a density of the embroidery design within the particular grid section. The display software provides a display of the grid sections of the divided embroidery design wherein each grid section has a color corresponding to its assigned value.

This software program and system of the invention have a number of advantages over the prior art. The software program and system provide an objective analysis of the density of an embroidery design. In addition, the software and system permit analysis and modification, if necessary, of a design before the design is applied to a fabric. Also, the risk of damaging or weakening a fabric by a design that is too dense can be evaluated and minimized.

Other objects and features will be in part apparent and in part pointed out hereinafter.

BRIEF DESCRIPTION OF THE DRAWINGS

The figures are lined for color.

Corresponding reference characters indicate corresponding parts throughout the drawings.

DETAILED DESCRIPTION OF PREFERRED EMBODIMENTS

Figure 1:
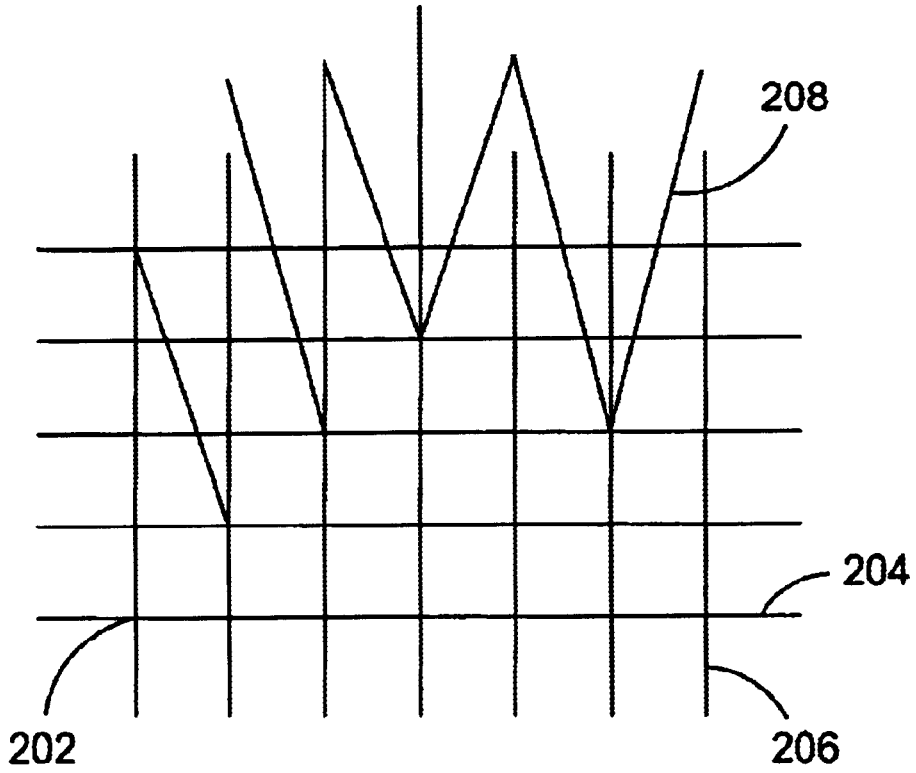
FIG. 1 is an illustration of stitching mapped onto a grid.

One purpose of the invention is provide a system and/or method which creates a set of data and/or a corresponding image on a computer that accurately represents the thread density of a machine-embroidered design. In one preferred form, the invention comprises software running on a personal computer which is linked to and controlling an embroidery machine.

The following provides exemplary definitions of the terms used herein. These definitions are provided by way of example and not for the purpose of limiting the invention or the scope of the claims of the invention.

Definitions

Thread weight is the thickness of a particular thread. Although manufacturers differ in their systems, the accepted rule of thumb is that a 40-weight thread will fill a 1.0 mm gap with 4 threads; a 30-weight thread will fill a 1.0 mm gap with 3 threads, etc.

Design Density is a term that describes the amount of thread used in a given design. If a given design uses a lot of thread, it is considered dense; if it does not use a lot of thread, it is considered loose. There are no rules used to determine density. The majority of embroiderers will say that if you can see the fabric under the design it is considered loose. Conversely, if the needle has difficulty penetrating previously sewn areas, it is considered dense.

Embroidery File is logically organized (although differently between manufacturers) into a series of individual stitches and colors. Embroidery takes place on a Cartesian plane, using the (x,y) coordinate system. The needle of the embroidery machine will start at the origin (0, 0) and move in a series of steps, referred to as stitches. At the end of each step, the embroidery machine cycles the needle mechanism to form a stitch in the fabric. After completing a series of stitches with the same thread, the machine will stop and request that a new thread color be used.

Stitch is a term used to identify a continuous, substantially straight segment of thread which begins a one fabric penetration and ends at a second fabric penetration. In other words, a stitch is a length of thread that spans and interconnects two fabric penetration points.

Embroidery design density is affected by many factors and, in particular, the following factors:

1) The number of stitches contained within an embroidery relative to that design's total area; and
2) The added 'weight' given to the design by the threads being embroidered.

As the thread weight increases, the design density increases because the threads require more area in which to lie within the same total embroidered area of the design. As the number of stitches increases, the density increases because the extra thread required to create the stitch is also occupying space in the embroidered area.

To enable a precise analysis of the density of a design, the system and method of the invention starts by defining a grid. Each section or square of the grid represents the size of the intended thread weight. The software of the invention includes grid software for dividing the embroidery design to be analyzed into a plurality of equal squares. For instance, if the operator wishes to use a 40-weight thread, each grid will represent 0.25 mm on each edge. Each grid is assigned a corresponding value, such as a positive integer, representing the amount of thread that is sewn over the grid area.

A computer driven by software may be used to evaluate the stitches in an embroidery design. As shown in FIG. 1, a computer creates two variables in its memory: x and y. These variables are initially set to zero. As the stitch values are read from the embroidery file, the values of x and y will increase or decrease depending on the data. A computer may display such data in the form of a bitmap, or graphic representation of its data. Each pixel (dot) of the bitmap can be set to a specific parameter such as a number, a color, a contrast or an intensity. As a result, the computer can draw an embroidery design in its memory by coloring the pixels of a bitmap to correspond with the thread that would be stitched by an embroidery machine.

Figure 2:
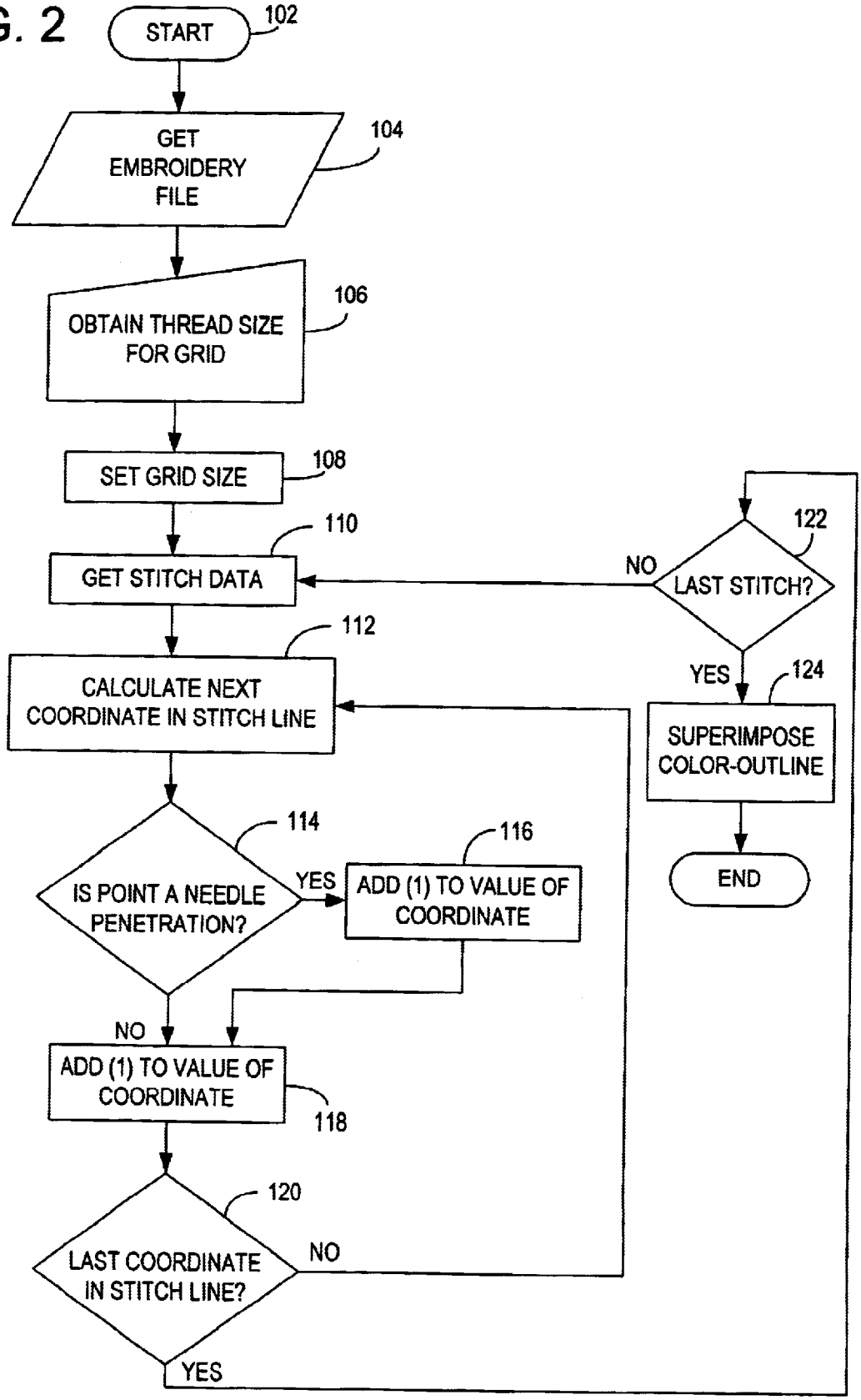
FIG. 2 is a flow chart of one preferred embodiment of the system and method according to the invention.

As illustrated in FIG. 2, the software is initialized at step 102 and the operator identifies the particular embroidery design to be manufactured so that the software can retrieve the corresponding embroidery file at step 104. At this point, the software obtains the thread size at step 106 from the retrieved file or from another file or the thread size may be designated by the operator. The software then sets the grid size at step 108 to be equal to or to otherwise correspond to the obtained thread size. This first portion of the software constitutes grid software for dividing the embroidery design to be analyzed into a plurality of grid sections.

Once such a grid is created, the design is drawn into the grid by value software for assigning a value to each particular grid section. The assigned value corresponds to a density of the embroidery design within the particular grid section. In particular, at step 110, the software gets the stitch data to begin the density analysis of the design. Each grid square is assigned a memory location within which will be stored a value which corresponds to the density of the grid. If a thread passes over a particular grid square, the assigned value of the particular grid square, which is initially zero, is incremented by 1. If a needle penetration occurs in a particular grid square, the assigned value of the particular grid square is incremented by 2. One reason for this latter increment is that the formation of a stitch actually occurs when two threads, the bobbin and the top threads, meet and hook, thus anchoring themselves to that spot. The resulting grid constitutes a plurality of grid squares, each having an assigned value that represents the amount of thread that has passed over the grid square coordinates.

The process of assigning a value to each grid square is accomplished by value software for assigned a value to each particular grid square so that the assigned value corresponds to a density of the embroidery design within the particular grid square. To accomplish this, the value software first calculates the next coordinate in the stitch line at step 112. Next, the software determines whether the calculated coordinate point is a needle penetration at step 114. If it is, steps 116 and 118 increment the value of the grid square by two (2). If it is not a needle penetration, step 114 bypasses step 116 and proceeds to step 118 to increment the value of the grid square by one (1).

The software next determines at step 120 whether the calculated coordinate is the last in the stitch line. If it is not, the software returns to step 122 to calculate the next coordinate in the stitch line. If it is the last in the stitch line, the software next determines at step 122 if the stitch is the last stitch. If it is not, the software returns to step 110 to get the next stitch data. If it is, the software proceeds to step 124 to superimpose a color outline onto the design.

The value of each grid square is translated into a pixel in a computer bitmap, both in memory and/or on a display. When the bitmap is displayed, it shows the different values of grid squares as different colors, called density colors. In one preferred embodiment, the following scheme for representing these values may be used:

0=Black
1=Blue
2=Light Blue
3=Green
4=Yellow
5=Orange
6=Red

In general, designs that sew over themselves more than 6 times are rare, but in any event, that design density usually considered high when a value of $\geqq 6$ is hit. This scale could be adjustable in terms of color and count if the user so desires. Rather than using integers as noted above, fractions can also occur when a thread encroaches only partially into a grid square. Fractional totals may be rounded to the nearest integer for simplicity. As an alternative, fractional values may be assigned and color and/or intensity may be varied to correspond to the fractional values.

The resulting bitmap is displayed to a user/operator. The software may include analysis software for evaluating the numeric data of the bitmap by any number of traditional statistical methods, and display software for displaying the results of such evaluation. For instance, the data may be evaluated according to a total percentage distribution so that a design that has less than 10% of its total area with a density over 5 could be considered not too dense. A design that has 10% of its encompassed area showing black or blue could be considered loose. Although the resulting analysis of an operator is still subjective, that operator now has accurate data upon which to base their conclusions.

Another factor that may be taken into consideration is the stretch of the thread. If a thread stretches under tension, its weight will be reduced. By calculating the size of a grid square on the thread weight, the grid size can be proportionally adjusted according to the estimated tension. The stretch of any given thread is available from the manufacturer, and is usually expressed in terms of percent. Typically, this value is low and can usually be ignored; however, the operator of the software will have the ability to vary the adjustment so that the display matches his/her experience with a given test design. Once the software is calibrated for that user, its calculations will remain constant and consistent with other, untried designs. The operator will have the ability to have the software store in memory the stretch characteristic of chosen threads so that the software can easily show their projects with their familiar set of threads.

The computer can also use this data in a rule-based or other artificial intelligence system to provide a user with information relating the design density. Other displays created from this data can also be created. A histogram of design density may be a useful tool to quickly characterize a design. An overall thread volume/design area number may also be used. This number could be calculated be estimating the thread linear usage times the thread volume divided by the design area.

Figure 3:
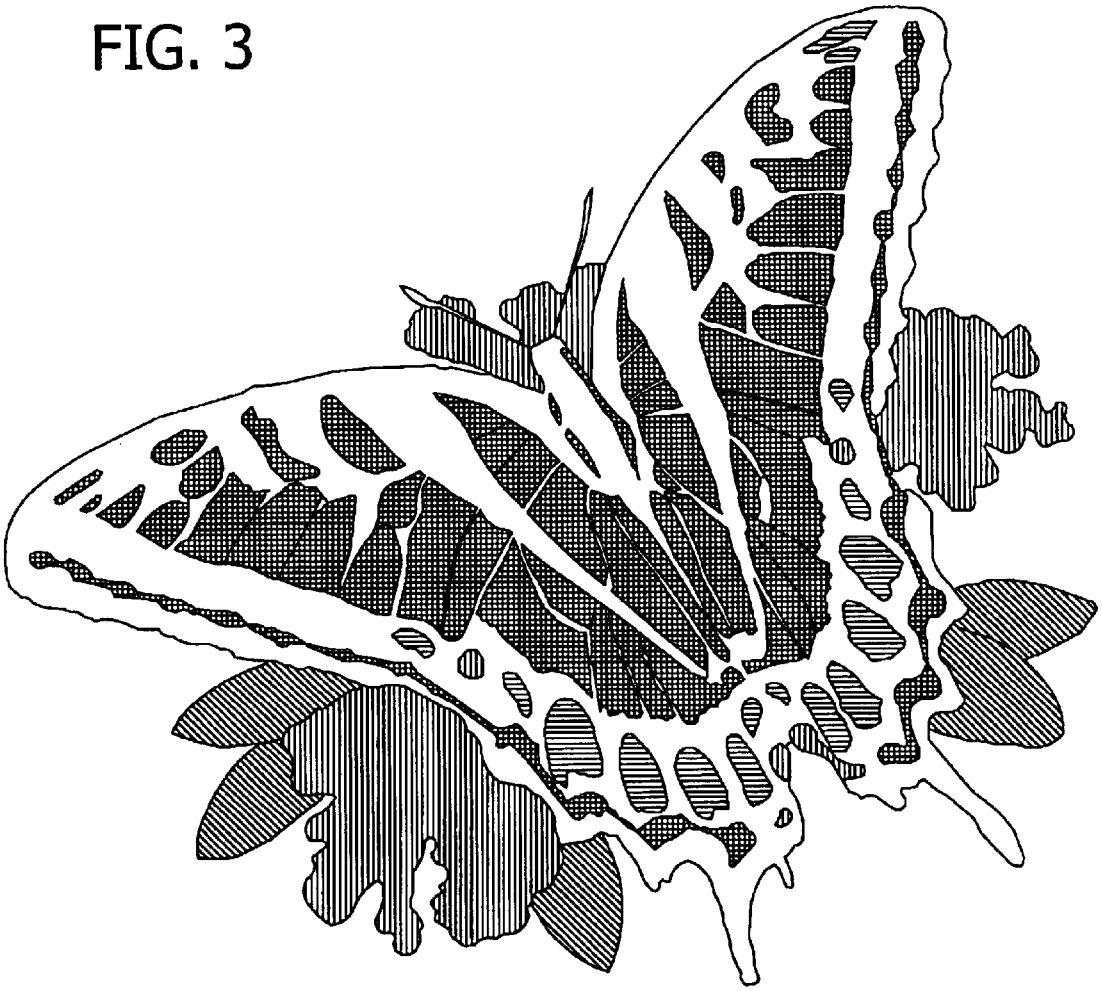
FIG. 3 is an exemplary illustration of an embroidery design of a butterfly which could be used by an embroidery machine to create an embroidered fabric.
Figure 4:
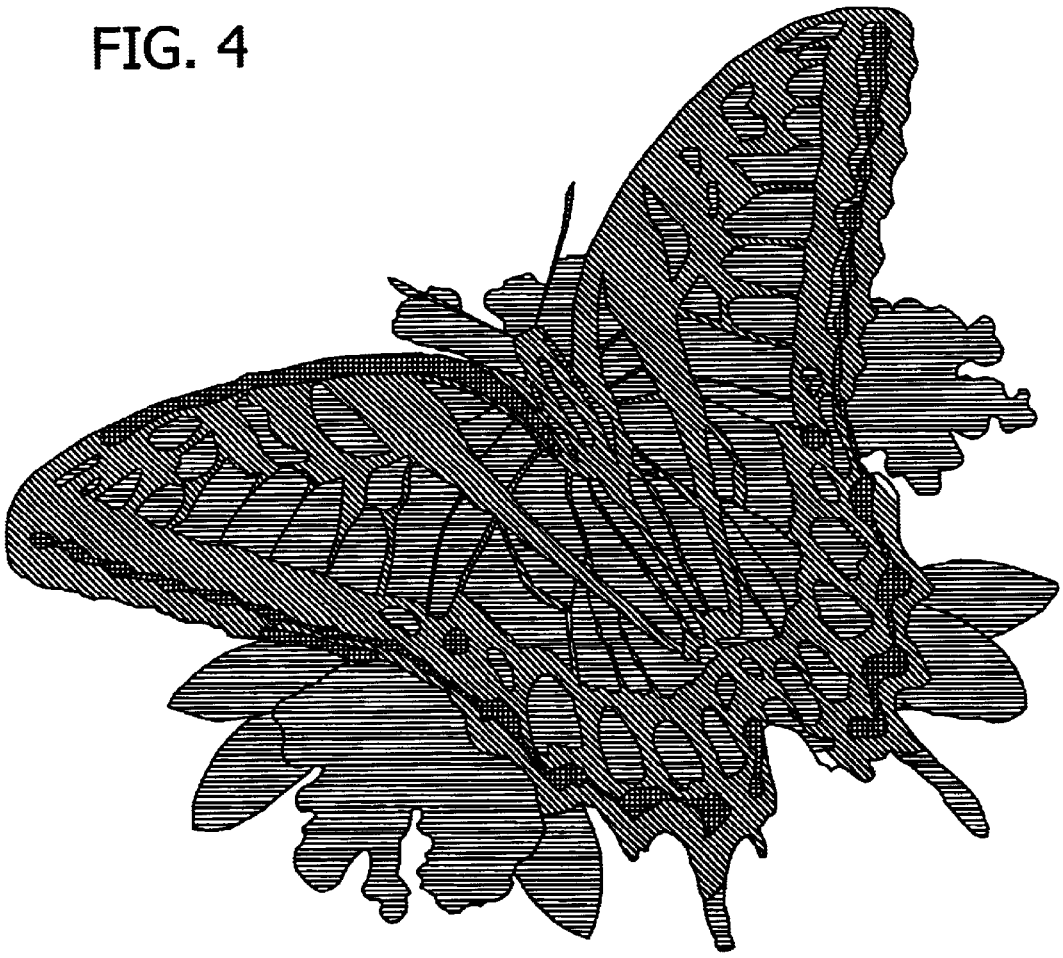
FIG. 4 is a density map according to the invention of the design of FIG. 3.

Once the above analysis is complete, a density map is generated, either in printed form or on a display, showing the design in the density colors. For example, FIG. 3 is an illustration of an embroidery design of a butterfly which could be used by an embroidery machine to create an embroidered fabric. The various shadings of FIG. 3 indicate different colors. If the above analysis were applied to the design of FIG. 3, a density map as shown in FIG. 3 would result. The operator is now able to objectively view the density of the design and determine whether any changes need to be made to the design prior to it's manufacture by an embroidery machine. For example, suppose this butterfly design will be embroidered on a light colored, stretch fabric. Looking at FIG. 4, an operator may decide that the resulting pattern will be too dense in the yellow areas in the center of the wings (see FIG. 3). This area may be considered "too dense" because the thread usage is higher than it needs to be. This is due, in part, to the fact that the light color of the fabric need not be completely covered up by the embroidery. This analysis results in a time and materials savings for the operator. Therefore, the operator can decide to modify the pattern to reduce the density in the yellow areas in the center of the wings. There are also some red areas that could be reduced in density. On the other hand, the operator may decide not to reduce the density of violet areas at the back of the wings because these areas need to be dense to properly stand out and because the light colored fabric may show through if the density is reduced. Due to the density of these areas of the design and the stretch nature of this fabric, the operator may decide to use a particular stabilizer to support the fabric. After the operator completes making changes to the design, the process may be repeated and a new density map presented to confirm that the changes have reduced the density in the appropriate areas. Once the operator is satisfied with the density map, the design can proceed to manufacture.

Alternatively, rather than colors, a display or printout of the value of each grid square may be provided to the operator for analysis. Alternatively, software could identify the coordinates of the grid squares having the higher or highest values and this information may be provided to the operator as data or a display. Alternatively, the software program may automatically modify the design, such as by deleting stitches, so that the modified design has a density which falls within a predefined range.

In view of the above, it will be seen that the several objects of the invention are achieved and other advantageous results attained.

As various changes could be made in the above products and methods without departing from the scope of the invention, it is intended that all matter contained in the above description and shown in the accompanying drawings shall be interpreted as illustrative and not in a limiting sense.

What is claimed is:

1. A software program for assisting an operator in analyzing an embroidery design represented by embroidery stitch data which will be used by an embroidery machine to create an embroidered fabric, said software program comprising:

grid defining software for defining a plurality of grid sections for the embroidery design; and value software for identifying the embroidery stitch data corresponding to each grid section and for assigning a value to each particular grid section based on the identified embroidery stitch data corresponding to each said particular grid section, said assigned value corresponding to a density of the embroidery design within the particular grid section.

2. The software program of claim 1 further comprising display software for providing a display of the grid sections wherein each grid section display has a parameter corresponding to its assigned value.

3. The software program of claim 2 wherein the parameter is a color of the grid section.

4. The software program of claim 3 wherein the color corresponds to an integer between 0 and N.

5. The software program of claim 4 wherein grid sections having a density greater than a maximum are assigned a value equal to N.

6. The software program of claim 5 wherein N=6.

7. The software program of claim 1 wherein each grid section has a size corresponding to a diameter of a thread to be used to create the embroidered fabric.

8. The software program of claim 7 wherein the size of each grid section is increased or decreased in proportion to a stretch of the thread to be used to create the embroidered fabric.

9. The software program of claim 1 wherein the assigned values correspond to a bitmap and further comprising analysis software for statistically evaluating the bitmap, and display software for displaying the results of the evaluation.

10. A software program for assisting an operator in analyzing an embroidery design represented by embroidery stitch data which will be used by an embroidery machine to create an embroidered fabric, said software program comprising:

grid defining software for defining a plurality of grid sections for the embroidery design; and display software for providing a display of the grid sections wherein each particular grid section display has a parameter based on embroidery stitch data corresponding to each particular grid section, said parameter corresponding to a density of the embroidery design within the particular grid section.

11. The software program of claim 10 further comprising value software for identifying the embroidery stitch data corresponding to each grid section and for assigning a color value to each parameter of each particular grid section based on the identified embroidery stitch data corresponding to each said particular grid section, said assigned color value corresponding to a density of the embroidery design within the particular grid section.

12. The software program of claim 10 wherein the parameter is a color of the grid section.

13. The software program of claim 12 wherein the color corresponds to an integer between 0 and N.

14. The software program of claim 13 wherein grid sections having a density greater than a maximum are assigned a value equal to N.

15. The software program of claim 14 wherein N=6.

16. The software program of claim 10 wherein each grid section has a size corresponding to a diameter of a thread to be used to create the embroidered fabric.

17. The software program of claim 10 wherein the size of each grid section is increased or decreased in proportion to a stretch of the thread to be used to create the embroidered fabric.

18. The software program of claim 10 wherein the parameters correspond to a bitmap and further comprising analysis software for statistically evaluating the bitmap, and display software for displaying the results of the evaluation.

19. A system for assisting an operator in analyzing an embroidery design represented by embroidery stitch data which will be used by an embroidery machine to create an embroidered fabric, said system comprising:

a personal computer including:

grid defining software for defining a plurality of grid sections for the embroidery design;

software for identifying the embroidery stitch data corresponding to each grid section and for assigning a value to each particular grid section based on the identified embroidery stitch data corresponding to each said particular grid section, said assigned value corresponding to a density of the embroidery design within the particular grid section; and display software for providing a display of the grid sections wherein each grid section display has a color corresponding to its assigned value.

20. The software program of claim 19 wherein each grid section has a size corresponding to a diameter of the thread to be used to create the embroidered fabric.

21. The software program of claim 20 wherein the size of each grid section is increased or decreased in proportion to a stretch of the thread to be used to create the embroidered fabric.

22. The software program of claim 19 wherein the assigned values correspond to a bitmap and further comprising analysis software for statistically evaluating the bitmap, and display software for displaying the results of the evaluation.

* * * * *